US008284036B2

(12) United States Patent
Wechtenhiser

(10) Patent No.: US 8,284,036 B2
(45) Date of Patent: Oct. 9, 2012

(54) DUAL ACTIVATED PNEUMATIC ACTUATOR SYSTEM

(75) Inventor: Bert W. Wechtenhiser, Jacksonville, FL (US)

(73) Assignee: Dwyer Precision Products, Inc., Jacksonville, FL (US)

( * ) Notice: Subject to any disclaimer, the term of this patent is extended or adjusted under 35 U.S.C. 154(b) by 931 days.

(21) Appl. No.: 12/321,648

(22) Filed: Jan. 23, 2009

(65) Prior Publication Data

US 2010/0187086 A1 Jul. 29, 2010

(51) Int. Cl.
*G07C 11/00* (2006.01)

(52) U.S. Cl. ..... 340/286.06; 200/306; 200/505; 200/81 H

(58) Field of Classification Search ..... 340/286.06; 200/303, 505, 81 H
See application file for complete search history.

(56) References Cited

U.S. PATENT DOCUMENTS 3,781,843 A 12/1973 Harrison et al.
3,823,285 A 7/1974 Dwyer
4,484,367 A 11/1984 Jenkins
4,702,443 A 10/1987 Callaway
5,155,309 A * 10/1992 Dwyer ..... 200/81 H
D339,570 S 9/1993 Dwyer
5,461,207 A 10/1995 Van Lear
5,736,702 A * 4/1998 Roberts et al. ..... 200/81 H
5,999,100 A 12/1999 Wright et al.
2006/0213756 A1* 9/2006 Takachi ..... 200/302.2

* cited by examiner

*Primary Examiner* — George Bugg
*Assistant Examiner* — Ojiako Nwugo
(74) *Attorney, Agent, or Firm* — Paul Bogdon

(57) ABSTRACT

A dual activated pneumatic actuator system for a patient call system includes a dual function hand held actuator for a pneumatic patient call system and having first and second air pressure domes; a pneumatically actuated switching device including two cylinders, contact pins and C-clips connected to the contact pins; and an air conduit system connecting the dual function hand held actuator to the pneumatically actuated switching device. When a first air pressure dome is depressed pressurized air forces a cylinder against its respective pin and C-clip to create a first circuit whereby an electrical signal is sent to an alarm system in the nurse station and when the second air pressure dome is depressed pressurized air forces the other cylinder against its respective pin and C-clip to create a second circuit whereby an electrical signal is sent to an electronic device, for example television or radio.

12 Claims, 7 Drawing Sheets

DUAL ACTIVATED PNEUMATIC ACTUATOR SYSTEM

BACKGROUND OF THE INVENTION

1. Field of the Invention

The present invention relates to a patient call system and more particularly to a dual activated pneumatic actuator system which is connectable to a nurse call system and to an auxiliary device, for example, an electronic device such as a television or a radio.

2. Description of the Prior Art

It is known in the art to use pneumatically actuated switches, rather than electrical switches, as part of nurse call systems. Such switches, disclosed for example in U.S. Pat. No. 3,823,285 to Dwyer, are particularly beneficial where combustion concerns may be present, as in oxygen rich environments, because the construction of the pneumatically actuated switch limits the possibility of arcing which is a problem associated with electrical switching.

The above U.S. Pat. No. 3,823,285 illustrates an example of a pneumatically actuated bulb device for a patient actuated nurse call system. This device includes a deformable pneumatic bulb to provide a source of pressurized air to operate an electrical switching circuit that is well suited for use in environments where it is undesirable to use a conventional electrical switch as discussed in the preceding paragraph.

A patient actuated call system is not only commonly used in hospital rooms but also in other health care facilities where there is a need or desire to summon personnel for help, particularly, when a patient is in a weakened or disabled condition. Most hospitals and health care institutions have signaling systems by which in each patient area, a patient may initiate a signal that is received at a station or at an allocated substation within a larger area to summon assistance. Typically, for example in a hospital, a select group of patient areas is serviced by a given nurse station where calls for assistance by patients are taken. Most patient areas must accommodate the use of oxygen even if it is only on an emergency basis whereby electrical switches commonly used in other industries cannot be utilized. The pneumatically operated switch disclosed in the aforesaid U.S. Pat. No. 3,823,285 provides an entirely satisfactory solution to the need for a pneumatically activated switching device which can operate in a very reliable fashion in hostile environments particularly atmospheres containing a high concentration of oxygen that could otherwise cause combustion. In this invention, a deformable bulb operated by the patient supplies pneumatic pressure to the substation for assistance.

A further development of a pressurizing device is disclosed in U.S. Pat. No. 5,155,309 which embodies a pneumatic bulb having an annular ring configuration with a convexly shaped actuator dome resembling a doughnut appearance to provide a distinctive identification to the bulb for distinction from other pneumatic bulbs that may be utilized for different purposes in a patient area. The construction of the pneumatic bulb includes a base plate to provide a board area of support for the bulb and support for a peripheral rim and a center post of the doughnut shaped actuator dome. The base plate includes protruding truncated conical members relied upon to maintain the doughnut shaped actuator at a fixed or pre-established location on a patient's mattress so that the patient can reliably find the bulb to summon help.

Examples of other known nurse call systems can be found in U.S. Pat. Nos. 4,702,443; 4,484,367; 4,298,863; and 3,781,843. In U.S. Pat. No. 4,702,443, a cord holding device is disclosed wherein a holding member supports a cord to allow limited movement of the cord, the end of which carries a push button electric switch. In U.S. Pat. No. 4,484,367, a side rail of a patient's bed is wrapped with a flexible sheet having a pocket for receiving an electronic push button device serving as a call device for summoning a nurse. U.S. Pat. No. 4,298,863 discloses a patient call system in which a patient operated transducer, mounted on a patient's face or a portion of the body, is interconnected by pneumatic tubing to a pneumatically actuated switch that is part of an electronic monitoring system. U.S. Pat. No. 3,781,843 discloses a bed guard system having restraining rails fitted with a detector. Each detector is formed with an elongated rail engaging pocket shape to fit on the rail surface and an overlying elongated internal cavity extending generally the length of the rail. The internal cavity forms a site for a fluid material which can be pressurized by an applied pressure to the top surface of the rail covering.

The above known pneumatically actuated patient call systems generally have a single switch for delivering pressurized air for triggering a switching device to produce an electrical signal in a nurse station for assistance.

There is a need to provide a pneumatically actuator for a patient call system which includes at least two actuators, one for delivering pressurized air for triggering a device to produce an electrical signal in a nurse station for assistance and the other for delivering pressurized air for triggering a device to produce an electrical signal to operate an auxiliary device, for example an electronic device such as a television or a radio.

There is a further need to provide an improved pneumatic actuator system including a pneumatic actuator for triggering at least two electrical devices, one connectable to the nurse station for assistance and the other connectable to an auxiliary device, for example an electronic device such as a television or a radio.

SUMMARY OF THE INVENTION

The invention has met these needs. The present invention provides a dual activated pneumatic actuator system for a patient call system, which includes: (a) a dual function hand held actuator for a pneumatic patient call system and having a first air pressure dome and a second air pressure dome for operation of an electrical device; (b) a pneumatically actuated switching device electronically connected to the electrical devices; and (c) an air supply system connected to the dual function hand held actuator device and the pneumatically actuated switching device for delivering pressurized air to the pneumatically actuated switching device when the dual function hand held actuator is operated. Via the pneumatically actuated switching device, depression of the first air pressure dome produces an electrical signal, preferably to an alarm system in a nurse station for assistance, and the depression of the second air pressure dome produces an electrical signal for operating an auxiliary device, for example an electrical device such as a television or radio.

The dual function hand held actuator includes a housing formed by an upper portion and a lower portion. The upper portion has an indented peripheral edge and two openings. The lower portion has a seat for receiving the indented peripheral edge of the top portion and for supporting the upper portion when the upper portion and the lower portion are assembled together. The lower portion further includes air pressurized structures for receiving air pressure domes. The air pressure domes extend through the opening of the upper portion. A first air conduit is in communication with a first air pressure dome for delivering pressurized air to a first compartment of the pneumatically actuated switching device for producing an electrical signal for an alarm system, for example, in a nurse station when the first air pressure dome is depressed. A second air conduit is in communication with the second air pressure dome for delivering pressurized air to a second compartment of the switching device, which, in turn, produces an electrical signal to activate an electrical device when the second air pressure dome is depressed.

The air pressure domes have a snap fit connection within the air pressurized structures of the actuator and are made of a flexible, depressible material, for example, soft polyvinyl chloride. The air pressurized structures of the dual function hand held actuator are adapted to limit the range of travel of the air pressure domes when the domes are depressed for delivering the pressurized air to the pneumatically actuated switching device. Ridged sections located preferably on an outer wall of the lower portion of the hand held actuator are provided for manually gripping the actuator. The air pressure domes have a different color, for example, white and red, for identifying purposes; that is, so that the patient knows that depression of the white pressure dome will send a signal to the nurse station; whereas, depression of the red pressure dome will send a signal to an auxiliary device.

The pneumatically actuated switching device includes: an actuator housing; a divider element inserted into the actuator housing for dividing the actuator housing into a first compartment and a second compartment; a first cylinder located in the first compartment; a second cylinder located in the second compartment; a plug switch having a sleeve extending into the actuator housing and having a first conductor connection attached to the sleeve of the plug switch and the divider element as a ground connection, a second conductor connection to the nurse station, and a third conductor connection to an electronic device; a cap having a snap fit in the top of the actuator housing and including a first contact for completing a first circuit when the first cylinder slides within the first compartment and against the first contact and a second contact for completing a second circuit when the second cylinder slides within the second compartment and against the second contact; a first air conduit means associated with the first compartment of the actuator housing for receiving pressurized air which forces the first cylinder against the first contact of the cap for completing the first circuit; and a second air conduit means associated with the second compartment of the actuator housing for receiving pressurized air which forces the second cylinder against the second contact of the cap for completing the second circuit.

The plug switch has a first enlarged radial area representing the first circuit and a second enlarged radial area representing the second circuit. The first conductor connection and the second conductor connection are associated with the first enlarged radial area of the plug switch and send a signal to the nurse station and the first conductor connection and the third conductor connection are associated with the second enlarged radial area of the plug switch and send a signal to the electronic device.

It is therefore an object of the present invention to provide a pneumatic actuator system for a patient call system that has at least two actuator depressors, one for activating and deactivating a signal to the nurse station for patient assistance and one for activating and deactivating a signal to an auxiliary device, for example, an electronic device such as a television or radio.

These and other objects of the invention will be better appreciated and understood when read in light of the accompanying drawings.

DETAILED DESCRIPTION OF THE INVENTION

Figure 1:
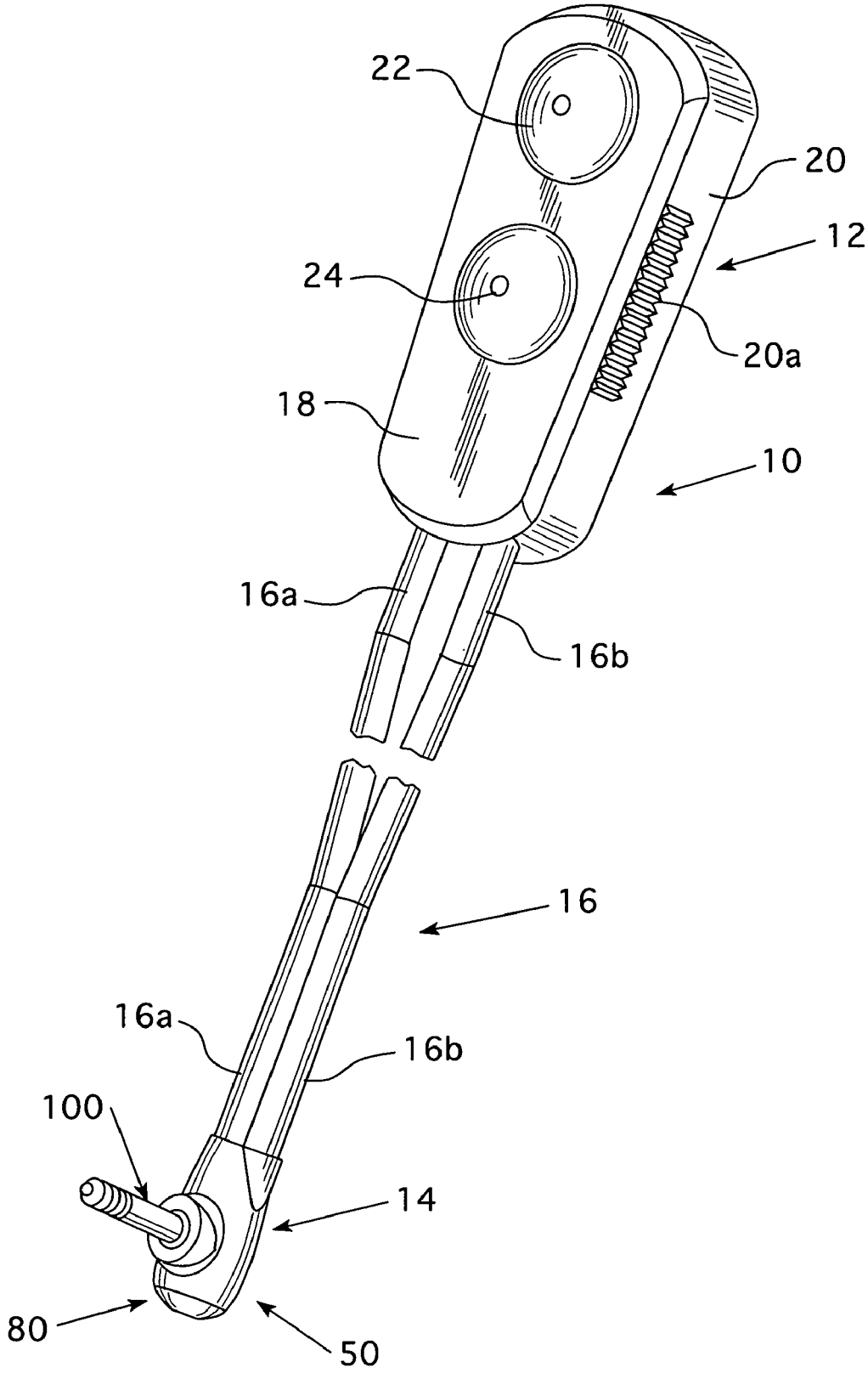
FIG. 1 is a schematic perspective view of a dual activated pneumatic actuator system for a patient call system of the invention.

In FIG. 1 there is illustrated a dual activated pneumatic actuator system 10 of the present invention. The dual activated pneumatic actuator system 10 includes a dual function hand held actuator 12 connected to a pneumatically actuated switching device 14 via an air supply system 16. The pneumatically actuated switching device 14 is connected electrically to a circuit, not shown, at some remote site for producing an alarm signal that is detected by personnel, such as a nurse and an electrical signal for operation of an auxiliary electronic device, such as a television or a radio. The present invention is particularly useful in a nurse call system utilized by patients in an oxygen atmosphere to summon help for assistance or fulfill a need for patient care as well as to fulfill the desire of the patient for operation of an auxiliary device such as a television or radio.

Figure 2:
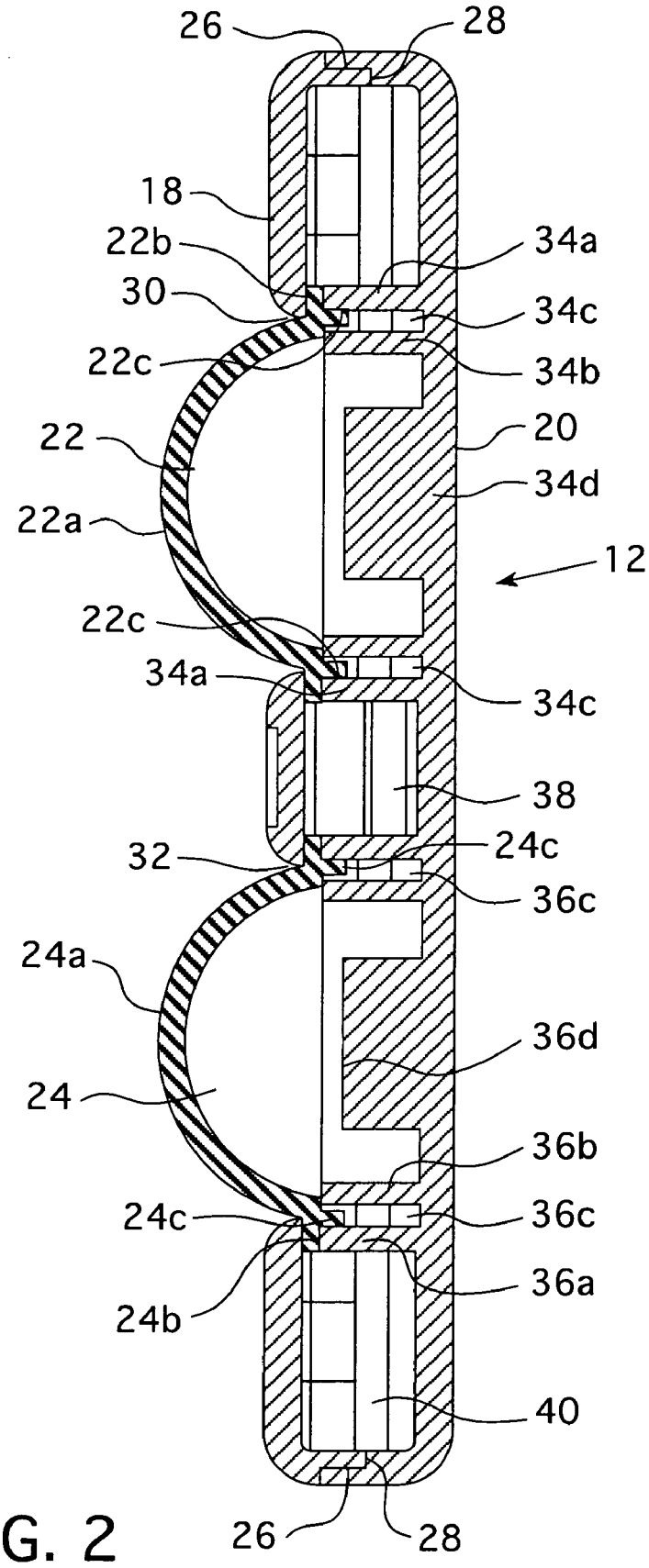
FIG. 2 is an enlarged sectional view of a dual function hand held actuator of the dual activated pneumatic actuator system of FIG. 1.
Figure 4:
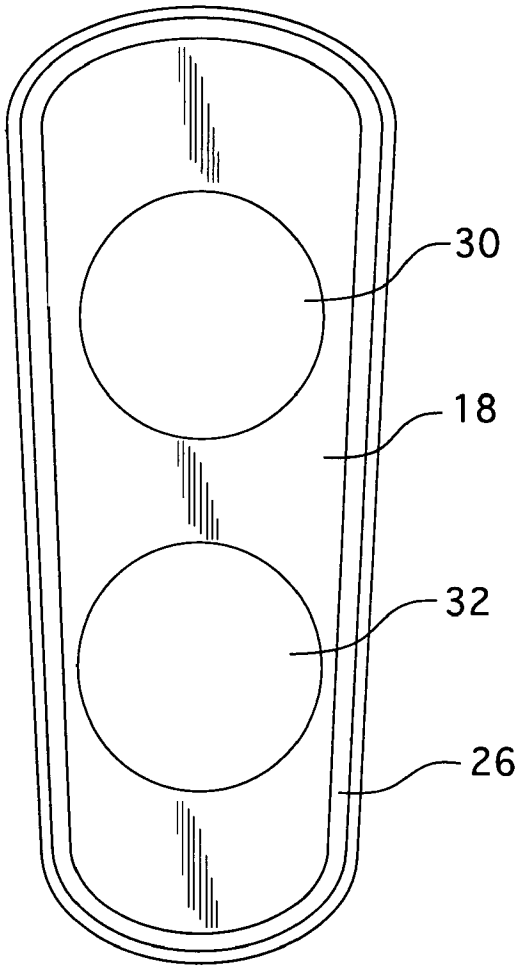
FIG. 4 is an enlarged bottom plan view of the upper portion of the dual function hand held actuator of FIG. 2.

The dual function hand held actuator 12 is shown in greater detail in FIGS. 1-4. As particularly shown in FIGS. 1 and 2, the dual function hand held actuator 12 includes a top portion 18 and a bottom portion 20, both of which are made of rigid plastic material, such as, for example, PVC (polyvinyl chloride). As particularly shown in FIG. 2, top or upper portion 18 has an indented peripheral edge 26 and bottom or lower portion 20 has a seat 28 for receiving the indented peripheral edge 26 when top portion 18 and bottom portion 20 are assembled. Still referring to FIG. 2, actuator 12 further includes air pressure domes 22 and 24. As particularly shown in FIG. 4, top portion 18 further includes an opening 30 through which air pressure dome 22 extends and an opening 32 through which air pressure dome 24 extends when top portion 18 and bottom portion 20 are assembled as shown in FIG. 2. Air pressure domes 22 and 24 are depressible and are made of a flexible fluid impervious material, such as elastomeric material, for example, rubber or plastic, e.g. soft polyvinyl chloride. It is to be appreciated that the geometry of domes 22 and 24 and their supporting structure on lower portion 20 may be such that the required amount of pressurized atmospheric air is produced by the domes 22 and 24 and delivered to the switching device 14 for activation and deactivation of respective electrical signals. Air pressure domes 22 and 24 have a different color, for example, white and red, for identifying purposes; that is, so that the patient knows that depression of the white pressure dome will send a signal to the nurse station; whereas, depression of the red pressure dome will send a signal to an electronic device. A second depression of the pressure domes will generally deactivate the signals, particularly, the pressure dome for the electronic device. That is, wherein a first depression of one of the domes will activate or turn the electronic device on, a second depression of this same dome will deactivate or turn the electronic device off.

Figure 3:
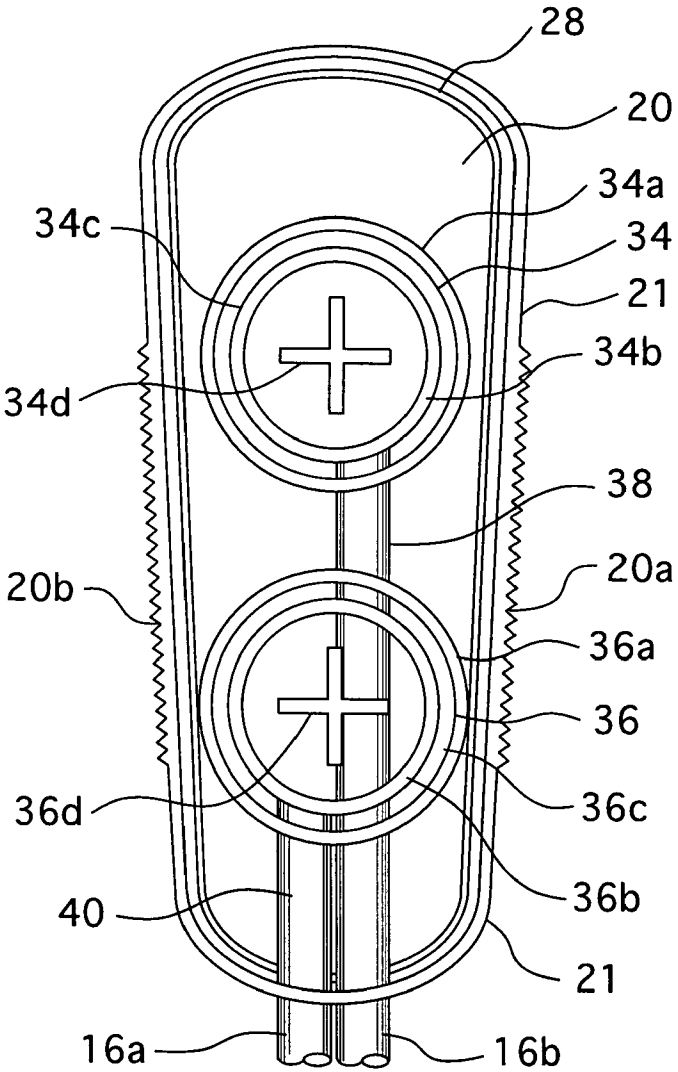
FIG. 3 is an enlarged top plan view of the lower portion of the dual function hand held actuator of FIG. 2.

FIG. 3 shows that the lower or bottom portion 20 also includes a first air pressurizing structure 34 and a second air pressurizing structure 36. In fluid communication with the first air pressurizing structure 34 is a first air conduit 38 and in fluid communication with the second air pressurizing structure 36 is a second air conduit 40. The first air pressurizing structure 34 is formed by an outer concentric annular projection 34*a* and an inner concentric annular projection 34*b* which forms an annular pocket 34*c*. The second air pressurizing structure 36 is formed by an outer concentric annular projection 36*a* and an inner concentric annular projection 36*b* which forms an annular pocket 36*c*. Ridged sections 20*a* and 20*b* located on an outer wall 21 of the bottom portion 20 of the hand held actuator 12 are provided for manually gripping actuator 12.

Referring again to FIG. 2, air pressure dome 22 has a dome-shaped central portion 22*a* merging with an outer annular rim portion 22*b* which has an adjacent rib 22*c*. Rib 22*c* has a central bulge that snap fits into annular pocket 34*c* formed by outer concentric annular projection 34*a* and inner concentric annular projection 34*b* of the first air pressurizing structure 34. Air pressure dome 24 has a dome-shaped central portion 24*a* merging with an outer annular rim portion 24*b* which has an adjacent rib 24*c*. Rib 24*c* has a central bulge that snap fits into annular pocket 36*c* formed by outer concentric annular projection 36*a* and inner concentric annular projection 36*b*. This arrangement of the air pressure dome 22 within the air pressurizing structure 34 forms an air tight connection to enclose a volume defining a pneumatic pump chamber wherein depression of air pressure dome 22 conducts a quantity of pressurized air through air conduit 38 (FIGS. 1 and 3). This arrangement of air pressure dome 24 within air pressurizing structure 36 forms an air tight connection to enclose a volume defining a pneumatic pump chamber wherein depression of air pressure dome 24 conducts a quantity of pressurized air through air conduit 40 (FIGS. 1 and 3). It is to be appreciated that the pressurized air that is developed in the actuator 12 is atmospheric air.

Referring again to FIG. 3, the first air pressurizing structure 34 includes a central section 34*d* and the second air pressurizing structure 36 includes a central section 36*d*. As shown, air conduit 38 extends through concentric annular projections 36*a* and 36*b* and central section 36*d* of the second air pressurizing structure 36, along bottom portion 20 and then through the concentric annular projections 34*a* and 34*b* of the first air pressurizing structure 34 and into the pneumatic pump chamber of the first air pressurizing structure 34. Central section 34*d* acts to limit travel of the first air pressure dome 22 when depressed and conducts a desired quantity of pressurized air through first air conduit 38 to trigger operation of a first device, more about which will be discussed herein below. As shown, the second air conduit 40 extends through concentric annular projections 36*a* and 36*b* and into the pneumatic pump chamber of the second air pressurizing structure 36. Central section 36*d* limits travel of the second air pressure dome 24 when depressed and conducts a desired quantity of pressurized air through the second air conduit 40 to trigger operation of a second device, more about which will be discussed herein below.

Referring particularly to FIGS. 1 and 3, it is to be appreciated that air conduit 38 is tightly connected to an air supply line 16*b* and that air conduit 40 is tightly connected to an air supply line 16*a* of the air supply system 16 of FIG. 1 for delivering pressurized atmospheric air to the pneumatically actuated switching device 14, which, in turn, is electronically connected to a circuit for producing electrical signals.

Figure 5:
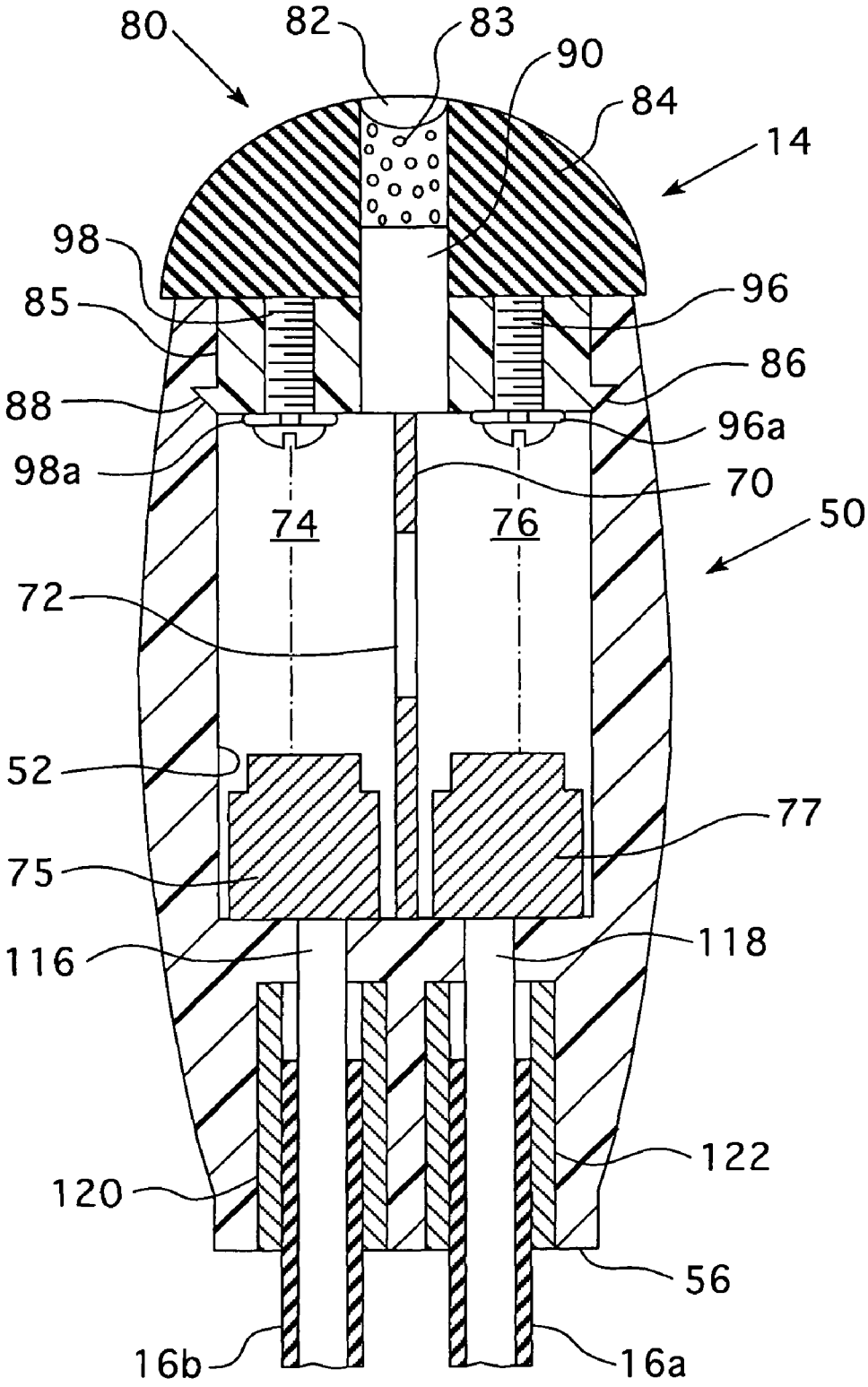
FIG. 5 is an enlarged sectional view of a pneumatically actuated switching device of FIG. 1.
Figure 6:
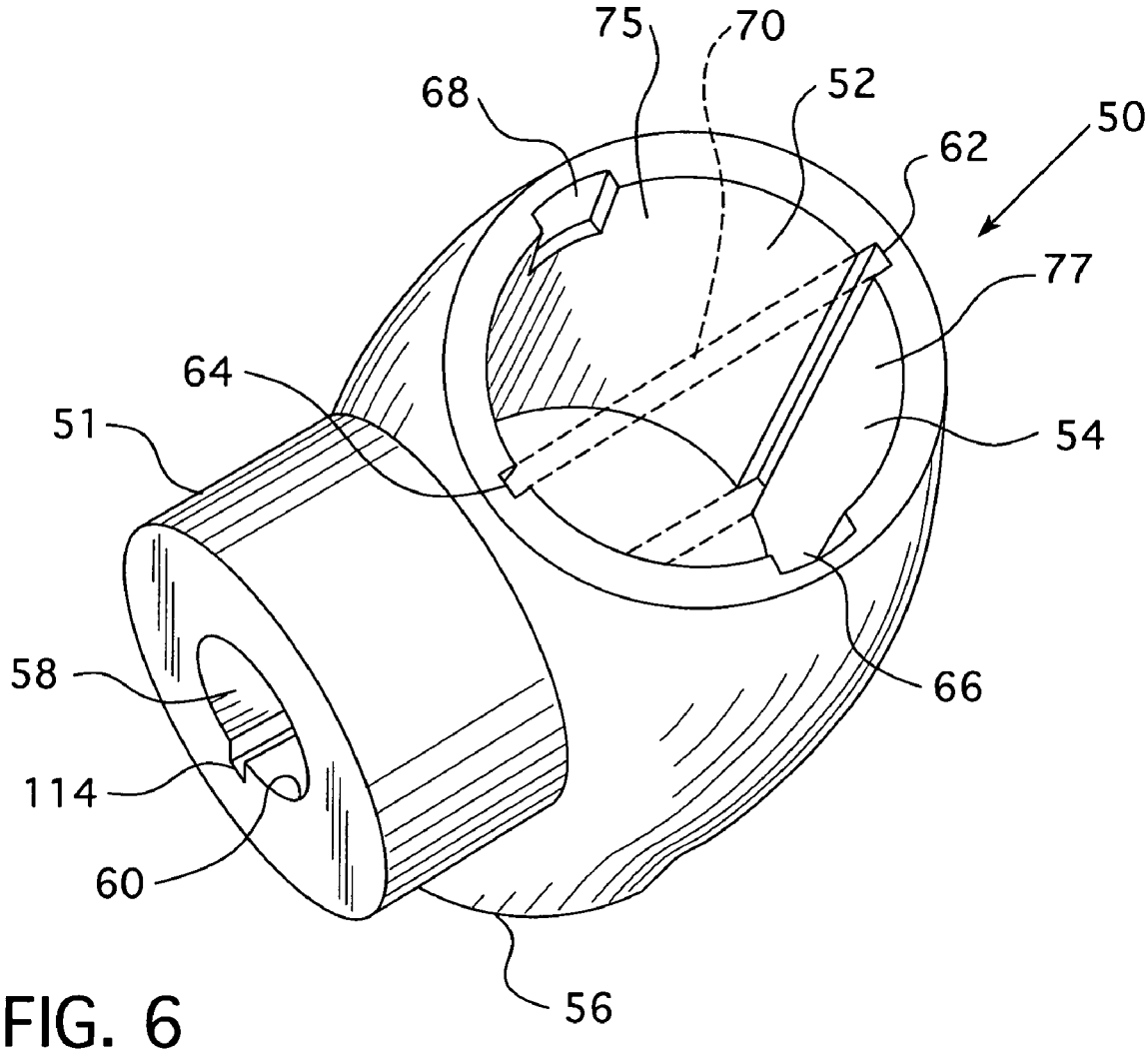
FIG. 6 is an enlarged top perspective view of the housing of the pneumatically actuated switching device of FIG. 5.

FIGS. 5-10 pertain to the pneumatically actuated switching device 14 of the invention. FIGS. 5 and 6 illustrate in detail an actuator housing 50 of the pneumatically actuated switching device 14 of FIG. 1. Referring particularly to FIG. 6, actuator housing 50 is made from a non-conductive material and has a first cylindrical bore 52 extending there through and has a top open end 54 and a bottom end 56, and a second cylindrical bore 58 extending in an enlarged boss 51 from the sidewall of housing 50. Second cylindrical bore 58 is positioned perpendicularly relative to first cylindrical bore 52. Second cylindrical bore 58 has an open end 60 and communicates with the first cylindrical bore 52. As clearly shown in FIG. 6, the first cylindrical bore 52 includes two diametrically opposed longitudinal slots 62 and 64 extending along the entire length of the sidewalls of housing 50; whereas the top open end 54 of housing 50 has two diametrically opposed upper indentations 66 and 68 which extend partially along the length of the sidewall of housing 50 near the top open end 54.

Figure 8:
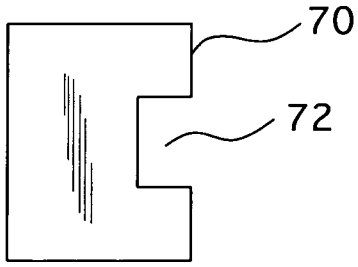
FIG. 8 is an enlarged side elevation view of a cap inserted into the top of the housing of the pneumatically actuated switching device of FIG. 5.

FIG. 8 shows a configuration of a divider element or shim 70 which generally is inserted into the two opposed longitudinal slots 62 and 64 of housing 50 of FIG. 6. Shim 70 is generally rectangular in shape and has a rectangular cutout 72. Shim 70 has a length approximately corresponding to the length of housing 50 and as shown in FIG. 5 insertion of shim 70 divides the cylindrical bore 52 into a first compartment 74 which contains a piston 75 which slides within compartment 74 and a second compartment 76 which contains a piston 77 which slides within compartment 76 as specifically illustrated in FIG. 5. Shim 70 and pistons 75 and 77 may be made of an electrically conductive material, for example, metal. Preferably, shim 70 is installed into cylindrical bore 52 such that the cutout 72 points outwardly toward boss 51 and the second cylindrical bore 58 of housing 50 as particularly shown in FIGS. 5 and 10.

Figure 7:
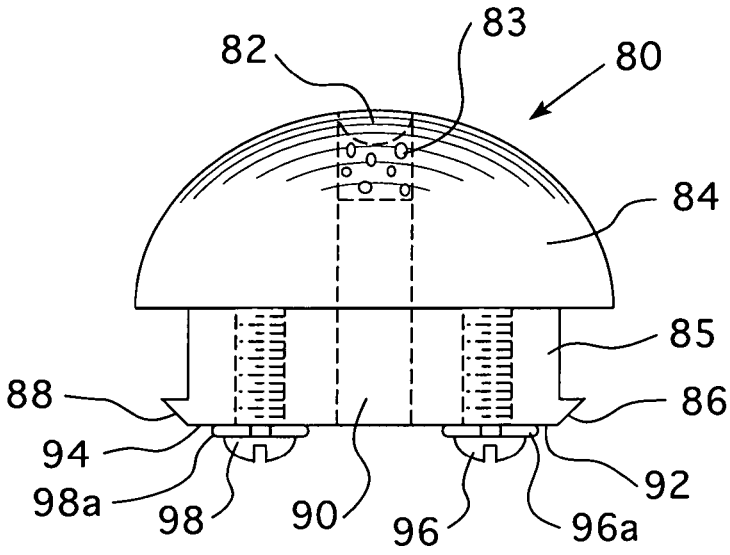
FIG. 7 is an enlarged side elevation view of a divider element inserted into the housing of the pneumatically actuated switching device of FIG. 5.

FIG. 7 shows a cap 80 for enclosing the first cylindrical bore 52 of housing 50 of FIG. 6. Cap 80 has a cavity 82 which is enclosed by a porous air filter 83 which is generally press-fit into cavity 82. Filter 83 may be made from any suitable material such as metal, refractory or plastic. The upper portion 84 of cap 80 has an annular configuration and a sidewall 85 which, in turn, has diametrically opposed flanges 86 and 88. Preferably cap 80 is made of rigid plastic material, for example, polyvinyl chloride with flanges 86 and 88 being flexible to the extent that they are capable of being pushed inwardly so that they can snap into and out of position relative to the two diametrically opposed indentations 66 and 68 of housing 50 (FIG. 6) for attachment of cap 80 in the top open end 54 of housing 50. As shown in FIGS. 5 and 7, sidewall 85 of cap 80 has a circular central opening 90 which communicates with the cavity 82 containing filter 83 for releasing air from housing 50. As obvious, filter 83 prevents debris from entering housing 50 which could interfere with the proper operation of the pneumatically actuated switching device 14. Sidewall 85 further includes projections 92 and 94 for receiving and carrying metal contact pins 96 and 98, respectively. Contact pins 96 and 98 may be pan-head slotted screws, which may be made of a material having excellent conductivity such as brass or silver. Contact pins 96 and 98 may be electrically connected to plug switch 100 of FIG. 9 via C-clips 96*a* and 98*a*, well known to those skilled in the art and as particularly illustrated in FIG. 10. For example, contact pin 96 may be electrically connected to plug switch 100 to activate an alarm (not shown) and contact pin 98 may be electrically connected to plug switch 100 to activate an electrical device (not shown).

Figure 9:
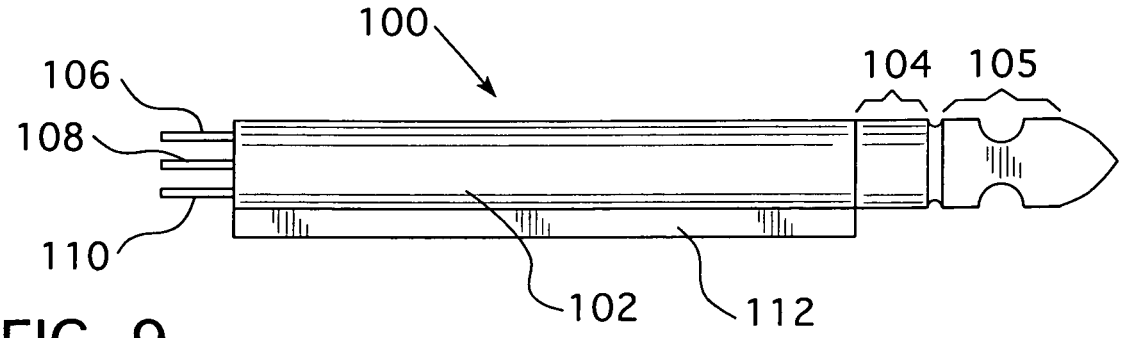
FIG. 9 is an enlarged elevation view of a switch plug inserted into the housing of FIG. 6.

Referring specifically to FIG. 9, plug switch 100 includes an insulating sleeve 102, a first enlarged radial section 104 representing a first circuit for activating a first device such as an alarm at a nurse station, a second enlarged radial section 105 representing a second circuit for activating a second device, and first, second and third electrical connections in the form of electrical leads or contact wires 106, 108 and 110 extending from insulating sleeve 102. Lead 106 is electrically connected via first enlarged radial section 104, lead 108 is electrically connected via second enlarged radial section 105, and lead 110 is electrically connected to insulating sleeve 102 and to divider element or shim 70 as a ground connection and is common to both leads 106 and 108 for completing a circuit. Lead 106 may be a black colored contact wire; lead 108 may be a red colored contact wire; and lead 110 may be a white colored contact wire.

Figure 10:
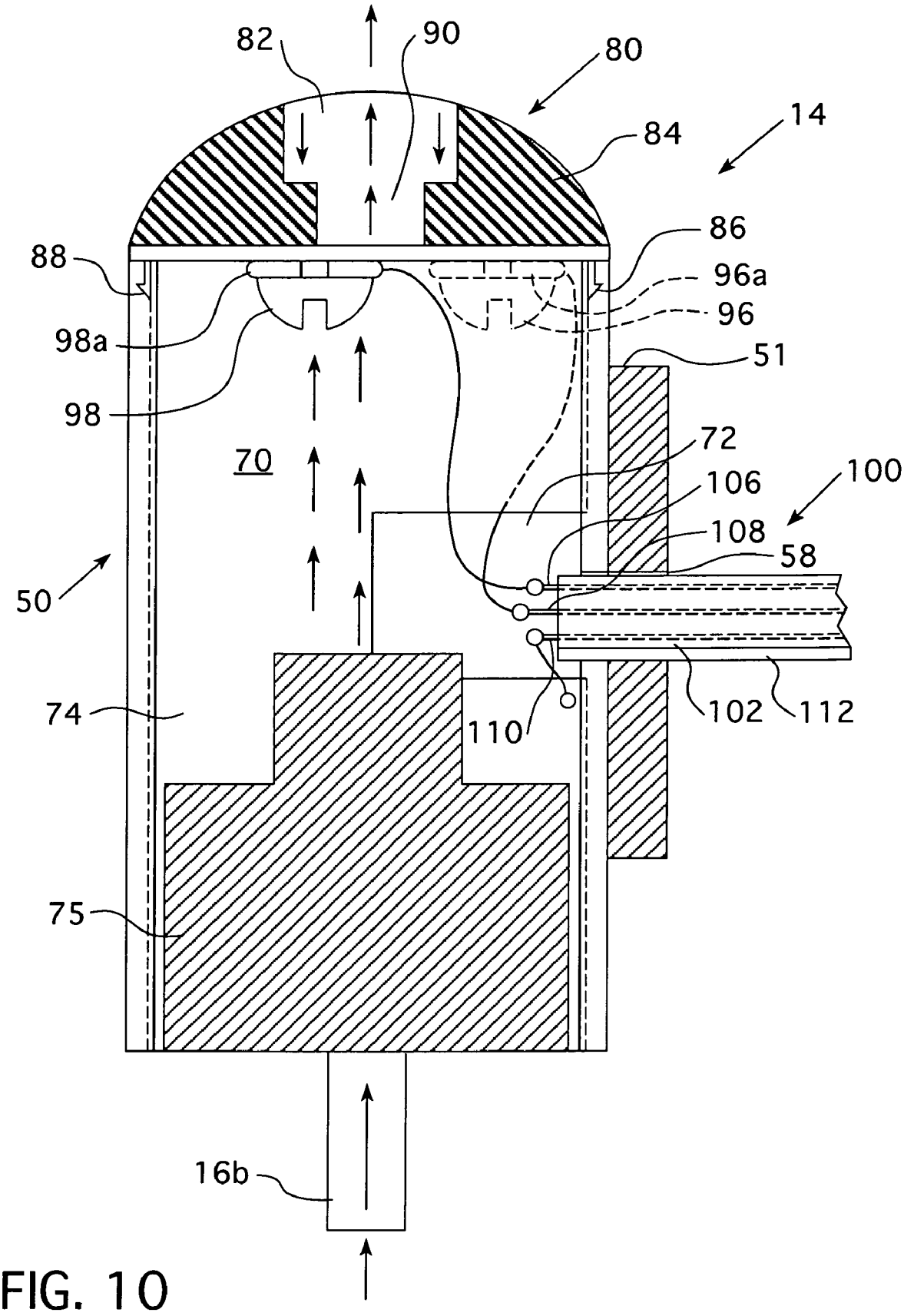
FIG. 10 is an enlarged sectional, schematic view of the pneumatically actuated switching device of FIG. 5 illustrating operation thereof.

As shown in FIG. 10, when plug switch 100 is installed in the cylindrical bore 58 of boss 51, it enters cutout 72 of shim 70. Plug switch 100 is affixed in cylindrical bore 58 via a key 112 of plug switch 100 (FIG. 9) and keyway 114 of boss 51 of housing 50 (FIG. 6).

Referring again to FIG. 5, below piston 75 is a pneumatic tube 116 which is in fluid communication with compartment 74 and below piston 77 is a pneumatic tube 118 which is in fluid communication with compartment 76 of housing 50. As shown, air supply line 16*a* is securely connected to pneumatic tube 116 in a leak-free connection via annular clamp 120 and air supply line 16*b* is securely fastened to pneumatic tube 118 in a leak-free connection via annular clamp 122.

FIG. 10 shows the pneumatically actuated switching device 14 in its assembled form including housing 50, shim 70, cap 80, and plug switch 100. In operation, plug switch 100 is inserted into a receptacle of an electrical system including for example a nurse call signal system and an auxiliary electronic device.

In FIG. 10, device 14 is illustrated in the context of a system in which the circuits are normally open; signals being initiated by closing the circuits. In a system which has an open circuit or circuits, piston 75 is spaced away from metal contact pin 98 and piston 77 is spaced away from contact pin 96. Contact pin 98 supports a C-clip 98*a* electrically connected to lead 106 and contact pin 96 supports a C-clip 96*a* electrically connected to lead 108. Insulated sleeve 102 is grounded to shim 70. When pressurized air is caused to travel through air supply line 16*b* and is caused to enter chamber 74 of housing 50 upon depression of dome 22 (FIG. 1), the pressurized air travels upwardly as shown by the arrow in supply line 16*b* forcing piston 75 to travel upwardly in chamber 74 for contact with contact pin 98 and its respective C-clip 98*a* thereby closing the circuit. The circuit is completed such that first enlarged radial section 104 of plug switch 100 (FIG. 5) sends a signal to activate an electronic device such as an alarm to the nurse station. In operation, plug switch 100 is inserted into a receptacle of an electrical system including for example, a nurse call signal system and an auxiliary electronic device.

With particular reference to FIG. 5, when pressurized air is caused to travel through air supply line 16*a* and is caused to enter chamber 76 of housing 50 upon depression of dome 24 (FIG. 1), the pressurized air travels upwardly similar to that shown in FIG. 10 forcing piston 77 to travel upwardly in chamber 76 for contact with contact pin 96 and its respective C-clip 96*a* (FIG. 10). A circuit is completed such that the second enlarged radial section 105 of plug switch 100 sends a signal to activate an electronic device, such as a television or radio. It is to be appreciated that one or more circuits are closed when pistons 75 and 77 slide upwardly in compartments 74 and 76 and make contact with contact pins 96 and 98, respectively. The circuits are open when pistons 75 and 77 are forced downwardly in compartments 74 and 76 and away from contact pins or screws 96 and 98. Pistons 75 and 77 are caused to be forced downwardly in compartments 74 and 76, respectively, via atmospheric air entering cavity 82 of cap 80 as indicated by the downwardly directed arrows in FIG. 10. It is to be appreciated that both circuits associated with pistons 75 and 77 and contact pins 96, 98 can be opened and/or closed at the same time. That is, domes 22 and 24 of actuator 12 may be depressed at the same time to send pressurized air to switching device 14 for activation and thereafter deactivation of the respective electronic devices.

Even though dual hand held actuator 12 for operating the switching device 14 is in the form disclosed herein, it is to be appreciated that the pneumatically actuated switching device 14 may also be effectively operated via individual actuators. These individual actuators may take the form of a pair of bulbs similar to that disclosed in U.S. Pat. No. 3,823,285 and the switching device and pressurized air supply may take the forms disclosed herein.

While the present invention has been described in connection with the embodiments of the various figures, it is to be understood that other similar embodiments may be used or modifications and additions may be made to the described embodiments for performing the same function of the present invention without deviating there from. Therefore, the present invention should not be limited to any single embodiment, but rather construed in breadth and scope in accordance with the recitation of the appended claims.

What is claimed is:

1. A dual function hand held actuator for a pneumatic patient call system, comprising:

an upper portion including a first opening and a second opening, a lower portion for supporting the upper portion and including a first air pressurizing structure corresponding to and communicating with the first opening of the upper portion and a second air pressurizing structure corresponding to and communicating with the second opening of the upper portion, a first air pressure dome received in the first air pressurizing structure of the lower portion and projecting through the first opening of the upper portion, a second air pressure dome received in the second air pressurizing structure of the lower portion and projecting through the second opening of the upper portion, a first air conduit in communication with the first air pressurizing structure of the lower portion for delivering pressurized air for activating a first device to produce an electrical signal in a nurse station when the first air pressure dome is depressed, and a second air conduit in communication with the second air pressurizing structure of the lower portion for delivering pressurized air for activating a second device to produce an electrical signal for operating an electrical device when the second air pressure dome is depressed.

2. The dual function hand held actuator of claim 1 wherein the first air pressure dome has a snap fit in the first air pressurizing structure of the lower portion; and wherein the second air pressure dome has a snap fit in the second air pressurizing structure of the lower portion.

3. The dual function hand held actuator of claim 1 wherein the first air pressure dome and the second air pressure dome are made of a flexible, depressible material.

4. The dual function hand held actuator of claim 3 wherein the flexible, depressible material is soft polyvinyl chloride.

5. The dual function hand held actuator of claim 1 wherein the first air pressurizing structure of the lower portion includes a central structure for limiting the range of travel of the first air pressure dome when depressed and for conducting a desired quantity of pressurized air for triggering the first device; and wherein the second air pressurizing structure of the lower portion includes a central structure for limiting the range of travel of the second air pressure dome when depressed and for conducting a desired quantity of pressurized air for triggering the second device.

6. The dual function hand held actuator of claim 1, wherein the lower portion further includes a gripping section.

7. The dual function hand held actuator of claim 1, wherein the first air pressure dome has a first color for indicating a signal to the nurse station and wherein the second air pressure dome has a second color for indicating a signal to an electronic device, and wherein the color for the first air pressure dome is different than the color for the second air pressure dome.

8. A dual activated pneumatic actuator system for a patient call system, comprising:

(a) a dual function hand held actuator for a pneumatic patient call system, comprising: an upper portion including a first opening and a second opening, a lower portion for supporting the top portion and including a first air pressurizing structure corresponding to and communicating with the first opening of the upper portion and a second air pressurizing structure corresponding to and communicating with the second opening of the upper portion, a first air pressure dome received in the first air pressurizing structure of the lower portion and projecting through the first opening of the upper portion, a second air pressure dome received in the second air pressurizing structure of the lower portion and projecting through the second opening of the upper portion, a first air conduit in communication with the first air pressurizing structure of the lower portion for delivering pressurized air for producing an electrical signal in a nurse station when the first air pressure dome is depressed, and a second air conduit in communication with the second air pressurizing structure of the lower portion for delivering pressurized air for producing an electrical signal for operating an electrical device when the second air pressure dome is depressed, (b) a pneumatically actuated switching device connected electronically to a circuit for producing the electrical signal in a the nurse station and for producing the electrical signal for operating the electrical device, and (c) an air conduit system comprising a first air supply line communicating with the first device and a second air supply line communicating with the second device.

9. A pneumatically actuated switching device comprising:

an actuator housing;

a divider element in the actuator housing for dividing the actuator housing into at least a first compartment and a second compartment;

a first cylinder located in the first compartment;

a second cylinder located in the second compartment;

a plug switch having a sleeve extending into the actuator housing and having a first electrical connection connected to the sleeve of the plug switch and to the divider element, a second electrical connection connected to the nurse station, and a third electrical connection connected to an electronic device, a cap having a snap fit into the top of the actuator housing and including a first contact for completing a first circuit when the first cylinder slides against the first contact and a second contact for completing a second circuit when the second cylinder slides against the second contact;

a first air conduit means associated with the first compartment of the actuator housing for receiving pressurized air which forces the first cylinder against the first contact of the cap for completing the first circuit, a second air conduit means associated with the second compartment of the actuator housing for receiving pressurized air which forces the second cylinder against the second contact of the cap for completing the second circuit, and wherein the plug switch has a first enlarged radial area representing the first circuit and a second enlarged radial area representing the second circuit, and wherein the first electrical connection and the second electrical connection are associated with the first enlarged radial area of the plug switch to send a signal to the nurse station and the first electrical connection and the third electrical connection are associated with the second enlarged radial area of the plug switch and sends a signal to the electronic device.

10. A dual activated pneumatic actuator system for a patient call system, comprising:

a dual function hand held actuator for a pneumatic patient call system and having a first air pressure dome and a second air pressure dome, a pneumatically actuated switching device, and an air conduit system connecting the dual function hand held actuator to the pneumatically actuated switching device and for delivering pressurized air to the pneumatically actuated switching device upon operation of the dual function hand held actuator for activating a first device to produce an electrical signal in a nurse station when the first air pressure dome is depressed and for activating a second device to produce an electrical signal for operating an electrical device when the second air pressure dome is depressed.

11. The dual activated pneumatic actuator system of claim 10, further comprising:

a snap fit cap enclosing said pneumatically actuated switching device.

12. The dual activated pneumatic actuator system of claim 11, wherein said pneumatically actuated switching device includes a first compartment containing a first slidable cylinder and a second compartment containing a second slidable cylinder, and wherein said snap fit cap including a first contact and a second contact, and wherein said first slidable cylinder contacts said first contact for activating said first device and said second slidable cylinder contacts said second contact for activating said second device.

* * * * *